United States Patent [19]

Sommer

[11] 4,176,841

[45] Dec. 4, 1979

[54] TENNIS RACKET

[76] Inventor: Reinhold Sommer, Helgolandring 68, 43 Essen 1, Fed. Rep. of Germany

[21] Appl. No.: 882,055

[22] Filed: Feb. 28, 1978

Related U.S. Application Data

[63] Continuation-in-part of Ser. No. 720,413, Sep. 3, 1976, abandoned, which is a continuation of Ser. No. 566,391, Apr. 19, 1975, abandoned.

[30] Foreign Application Priority Data

Apr. 10, 1974 [DE] Fed. Rep. of Germany ..... 2417439

[51] Int. Cl.[2] ..... A63B 49/12

[52] U.S. Cl. ..... 273/73 H

[58] Field of Search ..... 273/77 R, 80 R, 67 R, 273/73 R, 73 C, 73 D, 73 H

[56] References Cited

U.S. PATENT DOCUMENTS

| | | | |
|---|---|---|---|
| 2,164,631 | 7/1939 | Abell | 273/73 H |
| 3,625,512 | 12/1971 | Latham | 273/73 H X |
| 3,664,669 | 5/1972 | Latham et al. | 273/73 H X |
| 3,702,701 | 11/1972 | Vaughn et al. | 273/73 H |
| 3,809,402 | 5/1974 | Haines et al. | 273/73 H X |
| 3,834,700 | 9/1974 | Averbach | 273/77 R |
| 3,972,529 | 8/1976 | McNeil | 273/73 H X |

FOREIGN PATENT DOCUMENTS

| | | | |
|---|---|---|---|
| 1099400 | 1/1968 | United Kingdom | 273/73 H |
| 1322606 | 7/1973 | United Kingdom | 273/73 H |

*Primary Examiner*—Richard J. Apley
*Attorney, Agent, or Firm*—Montague & Ross

[57] ABSTRACT

A tennis racket has a frame comprising a hollow titanium profile curved to form a loop and two generally parallel legs held together by a handle, the legs being bridged by a web complementing the loop to form a substantially elliptical head spanned by strings. The profile has a wall thickness $T \approx 0.6$–$0.8$ mm, a width $W \approx 25T$–$40T$ and a height $H \approx 5T$–$20T$.

5 Claims, 7 Drawing Figures

TENNIS RACKET

CROSS-REFERENCE TO RELATED APPLICATIONS

This is a continuation-in-part of my copending and now abandoned application Ser. No. 720,413, filed 3 Sept. 1976 as a continuation of application Ser. No. 566,391 filed 19 Apr. 1975, also abandoned.

FIELD OF THE INVENTION

My present invention relates to a tennis racket whose frame is formed from a metal profile.

BACKGROUND OF THE INVENTION

It has already been proposed to make tennis-racket frames from various metals or alloys, notably from aluminum, magnesium or beryllium which have a low ratio of weight to stiffness. It has also been suggested (see British Pat. No. 1,099,400) to make the frames of smaller rackets, such as those used for badminton, of solid titanium.

The known metallic tennis-racket frames generally have a hollow profile indented to form an external groove on the frame which accommodates the strings. The groove bottom and the opposite profile wall, defining the inner frame periphery, have aligned perforations through which the strings pass, adjoining perforations being bridged by short string sections within the groove. The impact of a ball upon the strings tensions the latter, thus exerting a generally radial stress upon the profile section constituting the groove bottom; to absorb these stresses, the profile is frequently provided with internal reinforcing webs. A profile of this type is virtually nondeformable in the plane of the strings so that the striking force of the ball must be absorbed by the elasticity of the strings themselves and by the resiliency of the frame in the direction of impact, i.e. perpendicular to the string plane or face of the racket. Such a perpendicular deflection of the racket is undesirable since it diminishes the precision with which a player can hit the ball in a desired direction. Gut strings, which have the requisite elasticity, are expensive and have only a limited service life.

With rackets using strings of less elastic material, e.g. synthetic resin such as nylon, their resiliency may be increased by extraneous means such as coil springs connecting them with the frame. Reference may be made in this connection to my German published patent application Nos. 2,116,920 and 2,225,595.

OBJECT OF THE INVENTION

The object of my present invention is to provide an improved tennis racket, with a frame adapted to be massproduced from seamless or welded metal tubing, which can be used with inexpensive strings of limited elasticity without the encumbrance of connector springs or the like.

SUMMARY OF THE INVENTION

I have found, in accordance with my present invention, that this object can be realized with a frame constituted by a hollow profile consisting of preferably nonalloyed titanium (purity at least 95% by weight) which, though not normally thought of as elastic, has the necessary resiliency especially with wall thicknesses not exceeding one millimeter. The modulus of elasticity of titanium is about $10^{12}$ dynes/cm$^2$.

Advantageously, pursuant to further features of my invention, the profile has a width (measured parallel to the bottom of its frame groove) ranging between substantially 25T and 40T as well as a height ranging between substantially 5T and 20T where T is the aforementioned wall thickness. The value of T preferably lies between about 0.6 and 0.8 mm.

BRIEF DESCRIPTION OF THE DRAWING

The above and other features of my invention will now be described in detail with reference to the accompanying drawing in which.

SPECIFIC DESCRIPTION

In FIGS. 1–4 I have shown a tennis racket comprising a frame 1 in the form of a hollow profile consisting essentially of titanium, of preferably close to 100% purity. The profile is bent, in the usual manner, into a pair of generally parallel legs interconnected by a loop, the legs being bridged by a web 9—not necessarily of the same metal—complementing the loop to a substantially elliptical head. The extremities of the frame legs are interconnected by a handle 2 remote from that head, the loop being spanned by strings 3 of polyamide (nylon), for example. The strings are preferbly under a tension of about 210 newtons or 21 kiloponds (Kp=Kg-force).

Figure 3:
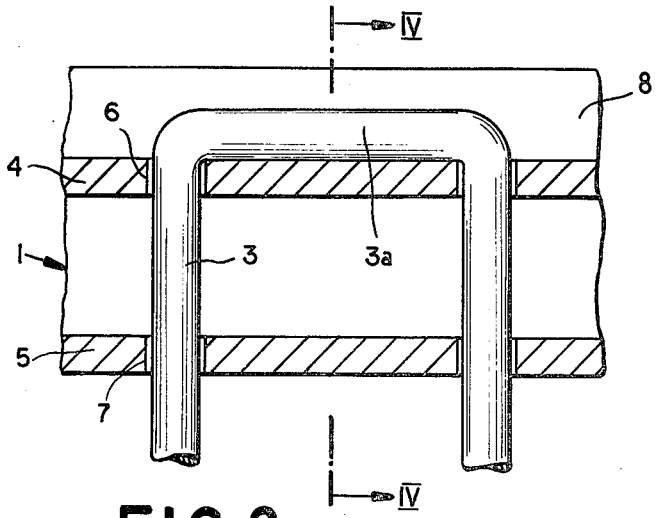
FIG. 3 is a cross-sectional detail view, drawn to a larger scale, of an area indicated at III in FIG. 1.
Figure 4:
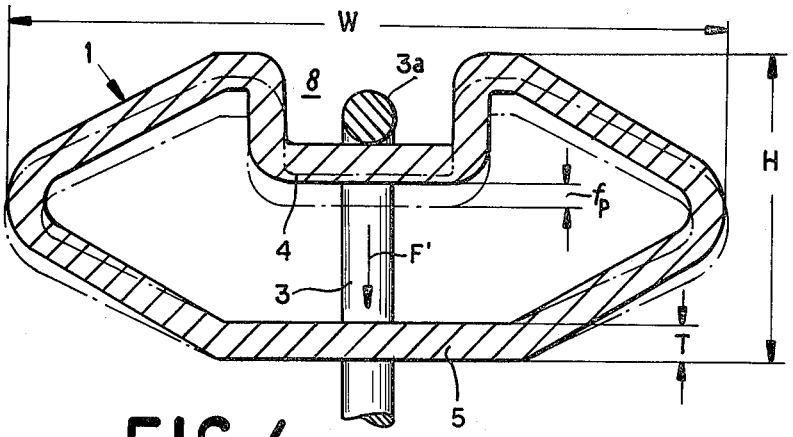
FIG. 4 is a cross-sectional view taken on the line IV—IV of FIG. 3.
Figure 5:
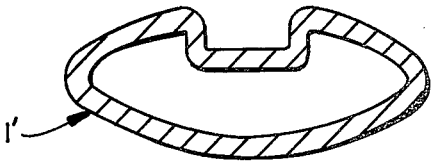
FIGS. 5 and 6 are views similar to FIG. 4, drawn to a somewhat smaller scale and showing modified frame profiles.
Figure 6:
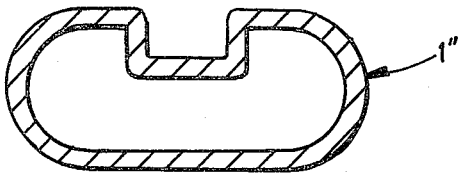

As seen in FIGS. 3 and 4, profile 1 has an indentation 8 forming an outer peripheral groove with side perpendicular to a bottom defined by a web 4 paralleling an opposite wall portion or web 5, the webs 4 and 5 being separated only by an air space so as to be relatively displaceable within the limits of elasticity of the lateral profile flanks which in this embodiment are generally triangular. As seen in FIGS. 5 and 6, however, modified profiles 1′ and 1″ may be formed with a more rounded outline; the following discussion applies also to these modified profiles.

Webs 4 and 5 are formed with aligned apertures 6 and 7 traversed by the strings 3 a section 3*a* of which comes to lie at the bottom of groove 8 against web 4. The profile has a wall thickness T, a width W parallel to webs 4, 5, and a height H transverse thereto. In a specific example, T=0.75 mm, W=22.5 mm and H=7.5 mm, corresponding to a ratio of W/T=30 and H/T=10.

Figure 2:
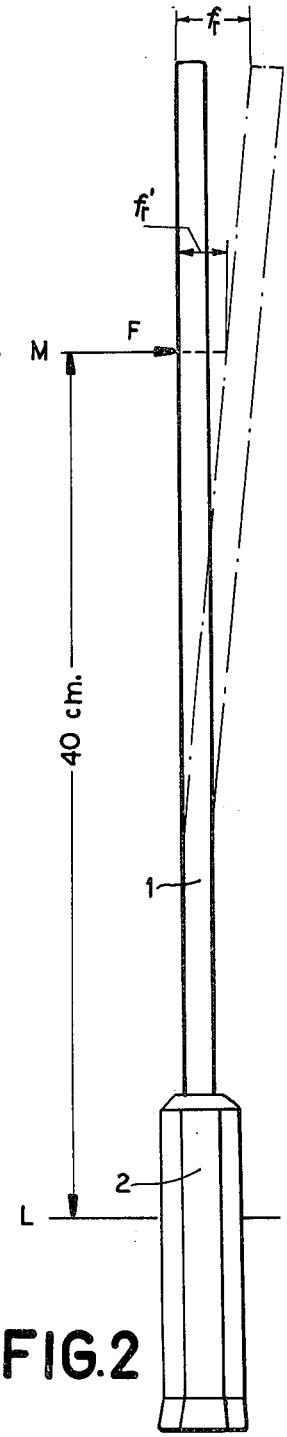
FIG. 2 is a side-elevational view of the racket shown in FIG. 1.
Figure 7:
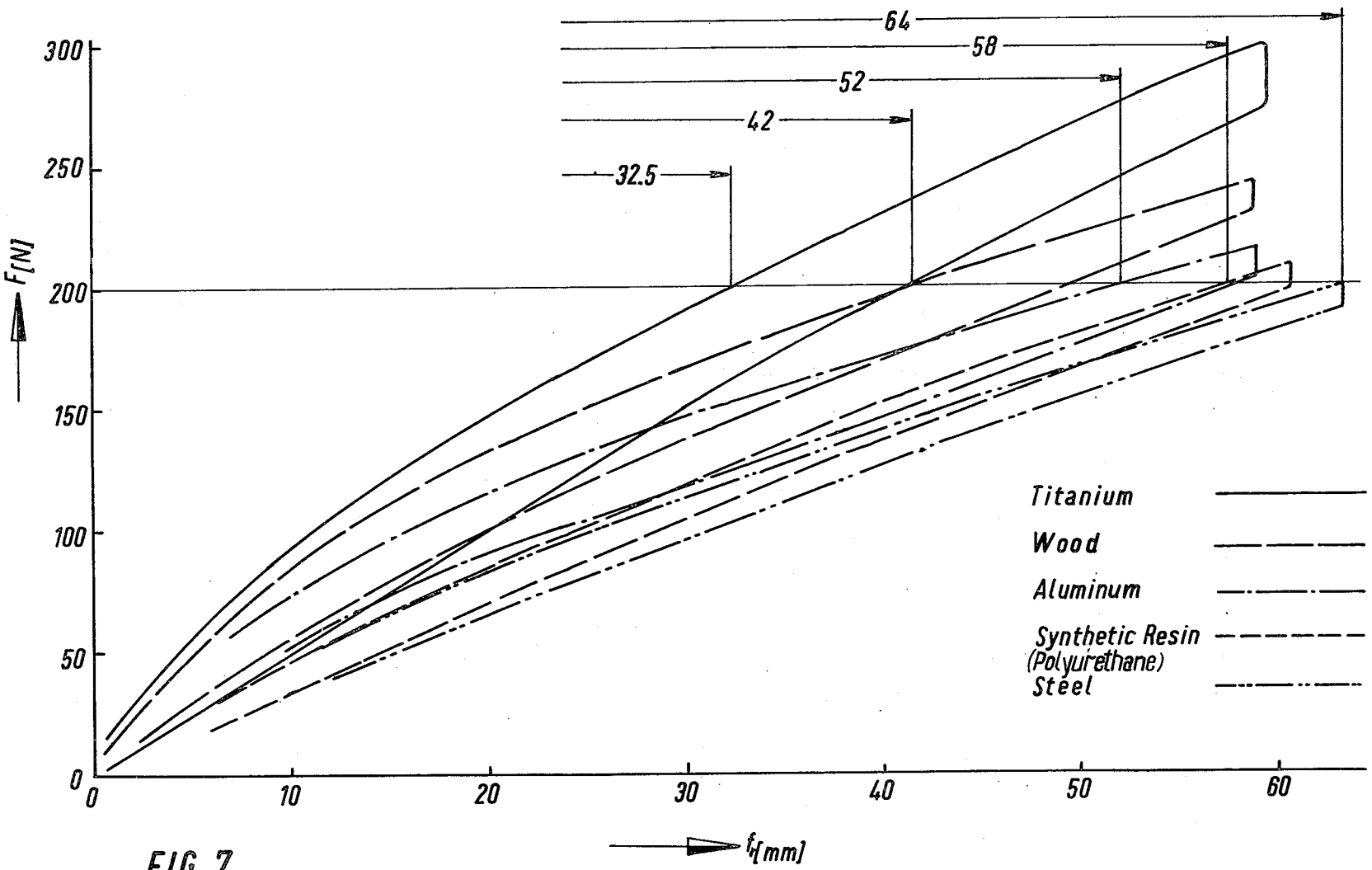
FIG. 7 is a set of graphs relating to the performance of my improved tennis racket.

As indicated in FIG. 2, the center M of the striking surface of the racket is separated by a distance of 40 cm from a line L in the upper half of handle 2 which approximately coincides with the position of the index finger of a player gripping that handle. If a ball strikes this center M with a force F, and if it is assumed that the player's arm does not yield, the racket undergoes a certain deflection above line L as indicated in phantom lines. The extent of that deflection at the free end of the racket has been designated $f_r$ and has been plotted in FIG. 7, in millimeters, against the striking force F in newtons (N) for comparable tennis rackets of various materials, namely titanium, wood, aluminum, synthetic resin (polyurethane) and steel, weighing 365,370, 375,375 and 380 grams, respectively.

As will be apparent from these curves, titanium has the greatest stiffness corresponding to a deflection of $f_r=32.5$ under a striking force of 200N; the deflection $f_r'$ at the point of impact M (FIG. 2) is about 20 mm. It will also be noted that titanium has the greatest hysteresis, which is advantageous since it minimizes the unpredictable velocity component due to backlash imparted to the ball by the deflected frame.

As indicated in phantom lines in FIG. 4, the additional tensioning of the strings 3 by the striking force F (FIG. 2) generates a radial force F' resulting in an elastic deformation $f_p$ of the profile 1. With a striking force F=200N, or 20Kp, and with the profile 1 dimensioned substantially as stated, this deflection $f_p$ along the line of impact amounts to about 0.2 mm; the radial force F' is approximately 16 N or 1.6 Kp, corresponding to a spring constant of 8 Kp/mm. Thus, the profile can be considered the equivalent of a pair of stacked Belleville springs absorbing a substantial part of the striking force.

Figure 1:
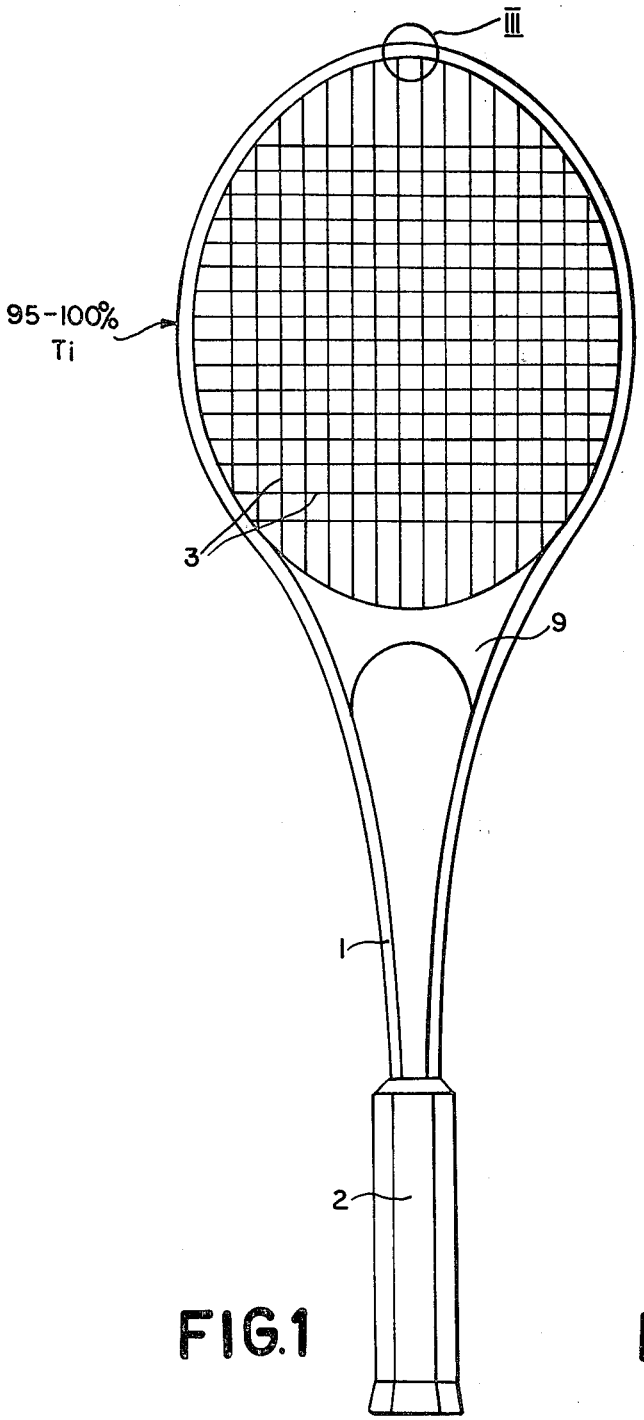
FIG. 1 is a face view of a tennis racket embodying my invention.

The profiles 1, 1' and 1'', whose height and width are substantially constant throughout their length as seen in FIGS. 1 and 2, can be formed in conventional manner by extrusion, i.e. in seamless fashion, or by rolling from sheet material and welding along a seam extending for example midway along web 5.

I claim:

1. A tennis racket comprising:

a frame constituted by a hollow profile with a wall thickness of 0.6 to 0.8 mm, consisting to at least 95% by weight of titanium, bent into a pair of generally parallel legs interconnected by a loop, said profile being free from internal reinforcements and having an indentation with a flat bottom generally parallel to an opposite profile wall and with sides perpendicular to said bottom defining an external groove on said frame, said profile having a width parallel to said bottom ranging between 25 and 40 times said wall thickness, said profile further having a height transverse to said bottom ranging between 5 and 20 times said wall thickness;

a web bridging said legs and complementing said loop to a substantially elliptical head;

strings partly received in said external groove and secured to said frame and said head; and a handle interconnecting extremities of said legs remote from said head.

2. A tennis racket as defined in claim 1 wherein said width is substantially 30 times said wall thickness and said height is substantially 10 times said wall thickness.

3. A tennis racket as defined in claim 1 or 2 wherein said strings are under a tension of approximately 21 kiloponds.

4. A tennis racket as defined in claim 3 wherein said strings consist of nylon.

5. A tennis racket as defined in claim 1 or 2 wherein said titanium is substantially 100% pure.

* * * * *